US008884838B2

(12) United States Patent
Contreras et al.

(10) Patent No.: US 8,884,838 B2
(45) Date of Patent: Nov. 11, 2014

(54) MULTI-BAND SUBSCRIBER ANTENNA FOR PORTABLE TWO-WAY RADIOS

(75) Inventors: Nereydo T. Contreras, Miami Beach, FL (US); Giorgi Bit-Babik, Plantation, FL (US); Antonio Faraone, Fort Lauderdale, FL (US); William R. Williams, Coral Springs, FL (US)

(73) Assignee: Motorola Solutions, Inc., Schaumburg, IL (US)

( * ) Notice: Subject to any disclaimer, the term of this patent is extended or adjusted under 35 U.S.C. 154(b) by 249 days.

(21) Appl. No.: 13/471,721

(22) Filed: May 15, 2012

(65) Prior Publication Data

US 2013/0307735 A1 Nov. 21, 2013

(51) Int. Cl.
*H01Q 1/36* (2006.01)
*H01Q 1/24* (2006.01)
*H01Q 21/30* (2006.01)

(52) U.S. Cl.
CPC . *H01Q 1/36* (2013.01); *H01Q 21/30* (2013.01)
USPC ..... 343/895; 343/702

(58) Field of Classification Search
CPC ..... H01Q 1/24; H01Q 1/242; H01Q 1/36; H01Q 1/50; H01Q 11/08; H01Q 21/30
USPC ..... 343/702, 715, 900, 895, 860
See application file for complete search history.

(56) References Cited

U.S. PATENT DOCUMENTS

| | | | | |
|---|---|---|---|---|
| 4,161,737 | A * | 7/1979 | Albright | 343/749 |
| 4,489,276 | A * | 12/1984 | Yu | 324/338 |
| 5,057,849 | A * | 10/1991 | Dorrie et al. | 343/722 |
| 6,587,081 | B2 * | 7/2003 | Noro et al. | 343/895 |
| 6,995,729 | B2 | 2/2006 | Govari et al. | |
| 7,202,829 | B2 | 4/2007 | Lan | |
| RE40,129 | E | 3/2008 | Warnagiris | |
| 7,355,558 | B2 | 4/2008 | Lee | |
| 7,369,050 | B1 | 5/2008 | DeGennaro et al. | |
| 8,054,230 | B2 | 11/2011 | Su et al. | |
| 8,115,690 | B2 | 2/2012 | Koh et al. | |
| 8,125,390 | B2 | 2/2012 | Kuramoto et al. | |
| 8,248,323 | B2 * | 8/2012 | Grossman et al. | 343/895 |
| 2007/0164921 | A1 | 7/2007 | Hu et al. | |
| 2009/0295672 | A1 | 12/2009 | Grossman et al. | |
| 2011/0084888 | A1 | 4/2011 | Nishioka et al. | |
| 2011/0241957 | A1 | 10/2011 | Ohara | |

FOREIGN PATENT DOCUMENTS

JP 2010-226579 * 10/2010 ..... H04B 1/18

* cited by examiner

*Primary Examiner* — Hoang V Nguyen
(74) *Attorney, Agent, or Firm* — Barbara R. Doutre; Daniel R. Bestor

(57) ABSTRACT

An antenna (100) having an antenna structure is provided. The antenna structure is formed of a rolled conductive strip having a first section (112) with overlap between successive turns and a second section (114) with no overlap between successive turns. The first section (112) has an insulating layer to prevent shorts between the successive overlapping turns. The antenna (100) provides multi-band capability.

25 Claims, 16 Drawing Sheets

MULTI-BAND SUBSCRIBER ANTENNA FOR PORTABLE TWO-WAY RADIOS

FIELD OF THE DISCLOSURE

The present invention relates generally to antennas and more particularly to antenna structures for multi-band applications.

BACKGROUND

The size of wireless communication devices is being driven towards smaller sizes while the desire to incorporate additional features into such devices continues to increase. Communication devices, such as portable two-way radios, which operate over different frequency bands are considered desirable, particularly in the public-safety arena where such devices are used by different agencies such as police departments, fire departments, emergency medical responders, and military, to name a few, which may own systems operating in different frequency bands. Thus the need for reliable interagency communications in emergency situations drives the need for wireless communication devices that enable reliable interoperability across systems. The use of separate antennas to cover different frequency bands is often not a practical option in view of the portability and size limitations of such devices, as well as the mentioned interoperability requirement.

One particularly useful combination of bands desirable to achieve in an portable two-way radio antenna comprises a very high frequency (VHF) band (about 136-174 MHz), an ultra high frequency (UHF) band (about 380-520 MHz), and a 7/800 MHz band (about 764-869 MHz). Other bands could also be desirable, for instance a global positioning system (GPS) band (about 1565-1585 MHz) or a long-term evolution (LTE) public-safety band (about 758-798 MHz). Furthermore, due to the need of emergency personnel to carry a portable two-way radio during an entire work shift and to operate effectively in dangerous environments, problems with antenna stiffness and overall size must be considered in such a design.

It is especially challenging to combine the above referenced bandwidths into a single structure. To be an effective radiator, antennas (also called radiating elements) normally have electrical lengths equal to, or some multiple of, a quarter of the wavelength $\lambda$. A good compromise between length and radiating performance for many portable radios is $\lambda/4$. Thus, a VHF radiating element designed according to this criterion has a relatively long physical length of about 50 cm at the center of the VHF band, while the UHF radiating element of $\lambda/4$ is about 18 cm, and the 7/800 MHz radiating element electrical length of $\lambda/4$ is about 9 cm. Creating a single length antenna that works efficiently at these disparate frequencies, while also minimizing the overall length and maximizing its flexibility, is difficult.

Accordingly, it is desirable to provide a multi-band antenna structure while retaining a relatively small form factor.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
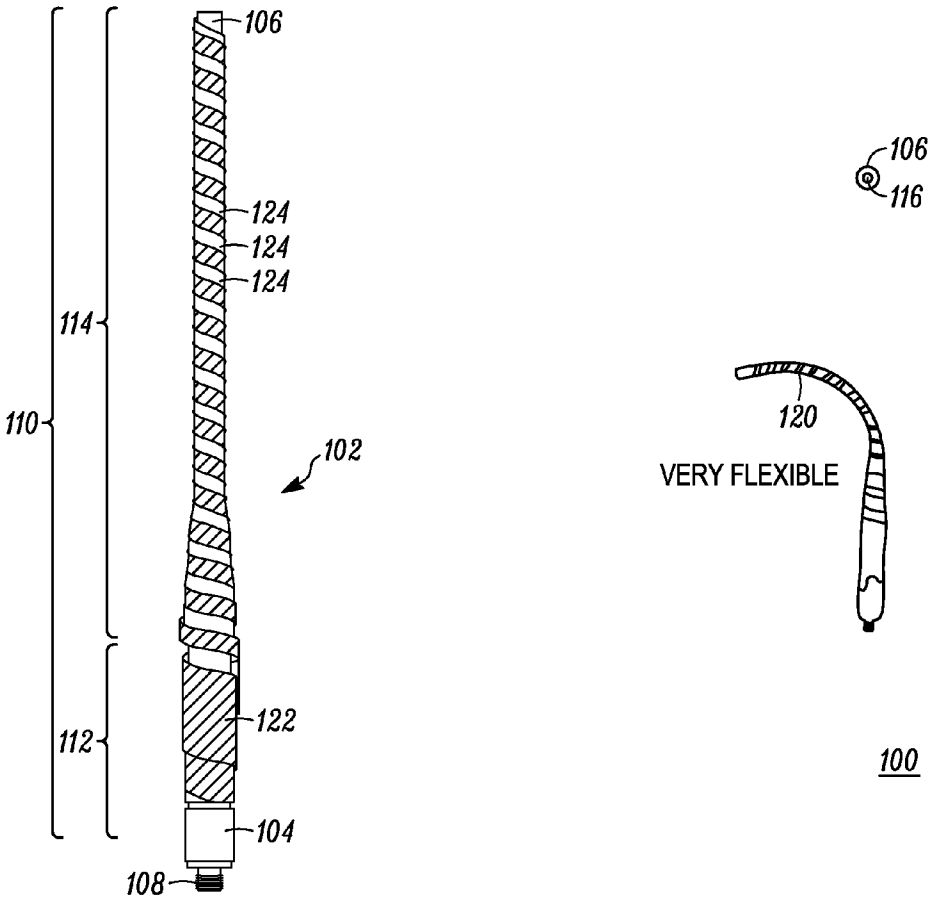
FIG. 1 is an antenna formed in accordance with the various embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there is provided herein a single combined antenna structure that functions in multiple bands. The antenna structure incorporates an overlapping and non-overlapping radiator structure allowing for a compact and flexible form factor. The antenna structure is particularly applicable to hand held wireless communication products, such as portable two-way radio subscriber units, where the available volume within the housing of the device is very limited. An antenna incorporating the structure, exhibits high performance over a considerable bandwidth within each of frequency bands of operation. The single combined structure operates over a very high frequency (VHF) band (about 136-174 MHz), an ultra high frequency (UHF) band (about 380-520 MHz), and a 7/800 MHz frequency band (764-869 MHz). A radio incorporating the new antenna structure is particularly advantageous for public-safety providers (e.g., police, fire department, emergency medical responders, and military) by providing increased communication options.

FIG. 1 is an antenna formed in accordance with the various embodiments. In accordance with the various embodiments, antenna 100 comprises an antenna structure formed of a rolled conductive strip 110 having a first section 112 with overlap between successive turns and a second section 114 with no overlap between successive turns. The overlap between successive turns 122 of first section 112 can be between each pair of successive turns 122 or between at least one pair of them. Rolled conductive strip 110 will also be referred to as conductive strip 110 when the strip is shown in its flattened state (in subsequent views).

The antenna 100 comprises a body 102 about which the rolled conductive strip 110 is wound. The antenna body 102 comprises a casing section 104 for housing electronic circuitry, such as impedance matching circuitry, examples of which are provided later. The body 102 further comprises a rod or core 106 coupled to the casing 104. The rod is preferably formed of a non-conductive material and preferably a flexible material, such as silicone, to provide flexibility for the antenna 100.

The rolled conductive strip 110 is wound about the casing 104 and the rod 106 as a single radiator element. The first section 112 of the rolled conductive strip 100 is wound around the casing 104 with overlap between successive turns 122. The first section 112 of the rolled conductive strip 110 comprises a non-conductive film, to prevent electrical shorts, between the overlapping successive turns 122.

The rolled conductive strip 110 transitions from the first section 112 of overlapping successive turns 122 along the casing 104, to the second section 114 of non-overlapping successive turns 124 along the rod 106. The rolled conductive strip 110 being wrapped in non-overlapping successive turns 124 about the rod 106, formed of a flexible material, advantageously provides flexibility 120 to the antenna 100.

The antenna 100 may further comprise an attachment means 108, such as a radio frequency (RF) connector or other suitable attachment means for mounting and coupling the antenna 100 to an electronic product incorporating transceivers that operate in one or multiple radio-frequency (RF) bands. Alternatively, the antenna 100 may be mounted and coupled directly to said electronic product.

In accordance with the various embodiments, antenna 100 having a single radiator element formed of the rolled conductive strip 110 provides tri-band coverage over the VHF, UHF, and 7/800 MHz frequency bands.

As a further embodiment, the rod 106 may further comprise a through-hole 116 for accommodating another radiating element if desired, for example an additional radiator element for adding GPS capability. Through-hole 116 may be partially filled to control the position of the additional radiator element.

Figure 2:
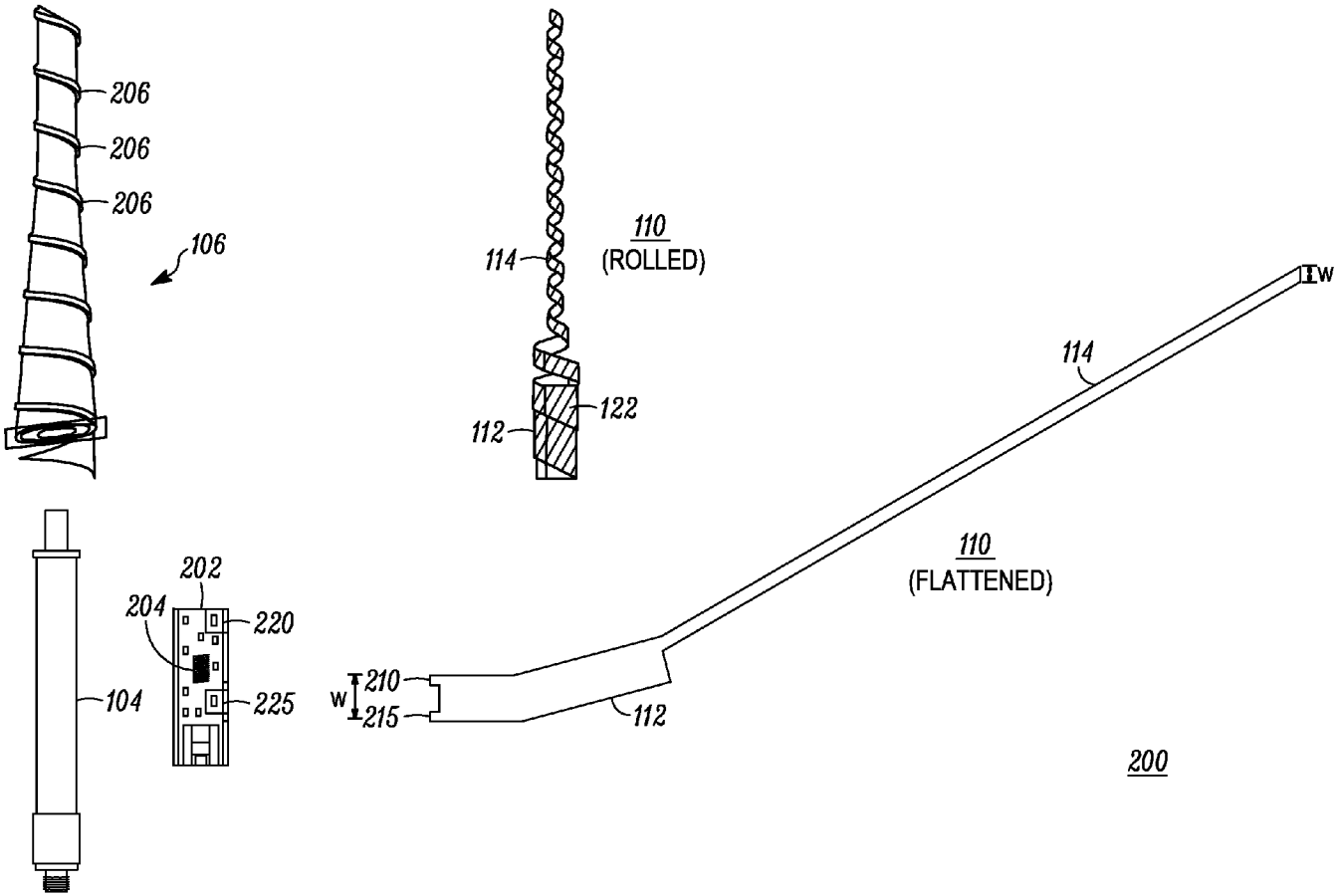
FIG. 2 is a disassembled view of the antenna of FIG. 1 in accordance with an embodiment.

FIG. 2 shows a disassembled view 200 of antenna 100 in accordance with the various embodiments. The components are not drawn to scale with respect to each other in order to facilitate viewing. The disassembled view 200 shows casing 104, rod 106 and the conductive strip 110. The conductive strip 110 is illustrated in both a flattened state (110 flattened) and a rolled state (110 rolled). The flattened views of conductive strip 110 shows the non-conductive side of the strip, while the rolled view shows the conductive side of the strip (marked with hatching). Although the first section 112 is drawn with a substantially uniform width "W", and the second section 114 is drawn with a substantially uniform width "w" in the flattened view 200, this is done for illustrative purposes only; "W" and "w" can be uniform, change abruptly or change continuously all along the length of the flat pattern to achieve the overlap/non overlap conditions of rolled conductive strip 110. View 200 also shows a printed circuit board (PCB) 202 having electronic components 204 mounted thereon. The electronic components provide matching circuitry for impedance matching the antenna to the transceivers in the electronic product to which the antenna 100 will couple.

In accordance with the various embodiments, the rolled conductive strip 110 provides a single radiator element for antenna 100. The conductive strip 110 may be formed of a single-sided flex circuit board having a conductive side, such as copper or other suitable conductor, and a non-conductive side, such as a polyimide film. Polyimide films, for example Kapton®, provide high performance, reliability and durability under various environmental conditions. The shape of the flattened conductive strip 110 shows the two main sections 112, 114, the first section 112 being formed of a width suitable for wrapping the case 104 containing the PCB 202 with overlapping successive turns 122. The flattened conductive strip 110 may be angled to provide an appropriate contour to facilitate wrapping of both the casing 104 in an overlapping configuration transitioning to the rod in a non-overlapping configuration. The shape of the first section 112 makes an angled contour along its length. The length and angle of section 112 is based on the size and shape of the casing 104 which enclosed the electronics 204. The first section 112 of the conductive strip 110 transitions to the second section 114 which is formed of a narrower width suitable for wrapping about the rod 106 with non-overlapping successive turns.

The rolled conductive strip 110 shows the single radiator formed of the first section 112 transitioning to the second section 114. In the rolled view, the first section 112 shows the wrapping of the first width, and the second section 114 shows the wrapping of the second width, the first width being typically wider than the second width. The contoured shape of flattened conductive strip 110 may facilitate wrapping about the casing 104 in an overlapping configuration transitioning to the rod 106 in a non-overlapping configuration. Depending on the size of the casing and the length of the rod, adjustments to the shape of the conductive strip can be made. The conductive strip includes solder points or contacts 210 and 215 for mounting to corresponding pads 220 and 225 on the PCB 202.

In accordance with the various embodiments, PCB 202 may comprise multiple dielectric layers. Conductive circuit patterns may be interposed between adjacent dielectric layers. Conductive circuit patterns may also be realized on the outside surfaces of the outmost dielectric layers. Conductive circuit patterns may be electrically interconnected through conductive vias crossing one or more dielectric layers, or other suitable means. For instance, PCB 202 may be realized using two layers of glass-reinforced epoxy laminate sheet, for example FR4, with a copper circuit pattern interposed between them and copper circuit patterns realized on the outer surfaces of each dielectric layer. Alternatively, PCB 202 may be realized using single-sided flex circuit board having a conductive side, such as copper or other suitable conductor, and a non-conductive side, such as a polyimide film, for example Kapton®. When conductive strip 110 is realized using single-sided flex circuit board as described earlier, it is then possible to extend the same flex circuit board to realize PCB 202. In this case, there is no need to realize solder points or contacts 210 and 215, and the corresponding pads 220 and 225; rather, the electrical interface (or interfaces) between PCB 202 and conductive strip 110 occurs (or occur) anywhere within the PCB 202 portion of the flex circuit board before first section 112 of conductive strip 110 starts wrapping about casing 104. The advantage to using such an approach is that PCB 202 and conductive strip 110 are realized as a single part with no need for assembly. The more general approach of using PCB 202 and conductive strip 110 as separate parts, thus requiring interfaces 210/220 and 215/225, is described in the following. Such a description includes the case where PCB 202 and conductive strip 110 are realized as a single part as described in the foregoing.

Only the first section 112 that has overlapping successive turns is required to have the insulating layer, to avoid shorts. However, having the insulating layer along both sections 112, 114 may facilitate the manufacturing of the conductive strip 110. Additionally, the use of a polyimide film as the insulating layer provides some capacitance and inductance characteristics that can improve performance of the antenna at UHF. Thus, the use of the insulating layer may not only eliminate shorts but also enhance performance. For instance, in some embodiments of the present invention, controlling the capacitance between successive overlapping turns 122 and the overall inductance of section 112 of conductive strip 110 allows tuning readily the frequency resonance of antenna 100 within the UHF band, with minimal effect on the VHF and 7/800 MHz resonances. From a manufacturing standpoint forming the conductive strip 110 as a single-sided flex circuit board with the insulation along the entire strip or predetermined portions of the strip provides a low cost element which is easy to manufacture.

The rod 106 may be made of silicone, or other suitably flexible elastomeric material with good RF properties, such as low RF losses. In view 200, the flexible rod decreases in diameter along a vertical axis. This feature is extremely advantageous in achieving flexibility 120 while enabling enough volume in first section 112 to host PCB 202 and associated electronics 204 performing an impedance matching function. The flexible rod 106 may further comprise a helical ridge 206 formed along a vertical axis of the flexible rod. The ridges provide spacers so that second section 114 of conductive strip 110 can be easily wound between the helical ridges of the rod. The components of FIG. 2 are described next in various stages of assembly.

Figure 3:
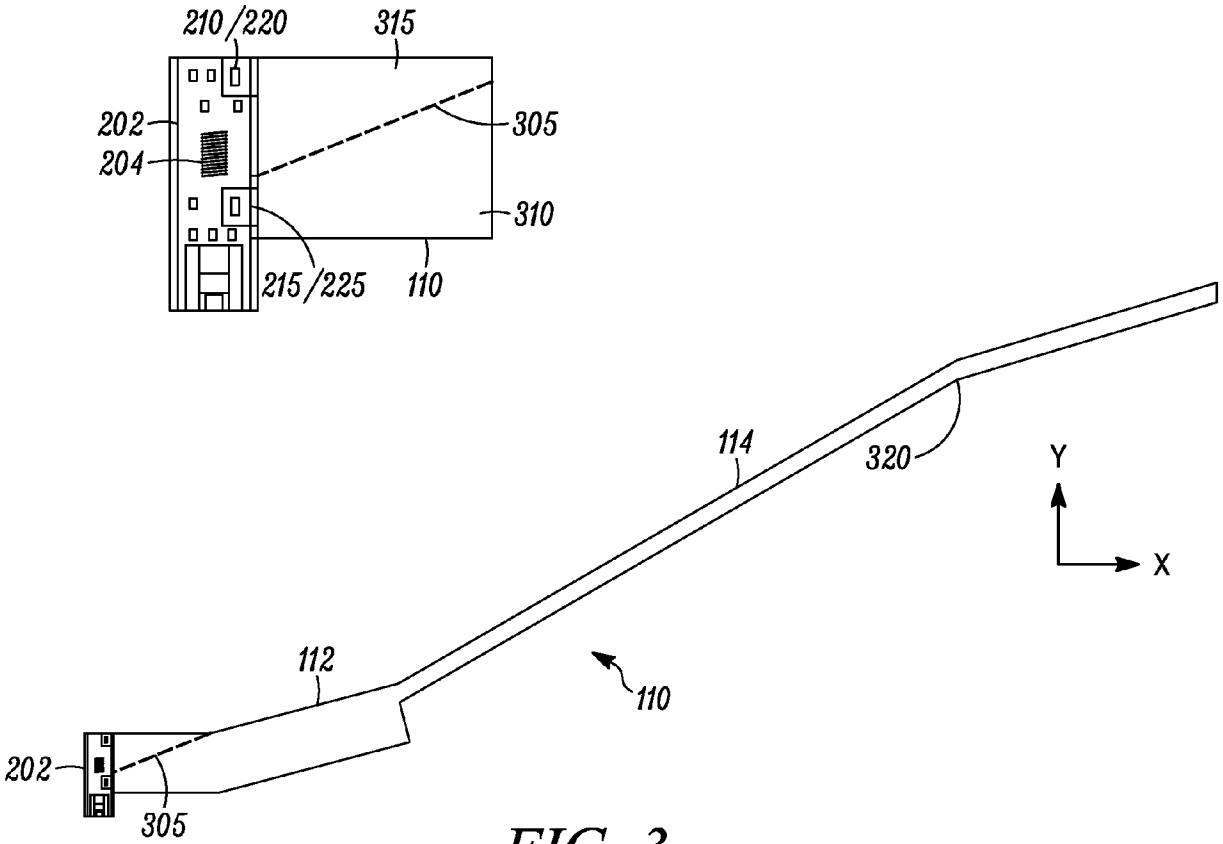
FIG. 3 shows an alternative embodiment of the conductive strip flat pattern of FIG. 1 coupled to a printed circuit board (PCB) in both a close-up view and a full view in accordance with the various embodiments.

FIG. 3 shows the conductive strip 110 coupled to the PCB 202 in both a close-up view and a full view in accordance with the various embodiments. These views show the non-conductive side of the strip 110. At least one contact transfers the RF signal between the PCB 202 and conductive strip 110. The conductive strip 110 may be coupled to the PCB 202 via contact/pad interface 210/220, or via contact/pad interface 215/225, or both interfaces 210/220 and 215/225 in a variety of embodiments. Contact/pad interfaces 210/220 and 215/225 may also be referred to as first interface 210/220 and second interface 215/225.

In the embodiment of FIG. 3, the PCB 202 and conductive strip 110 are coupled at interface 215/225. The conductive strip 110 features an edge 305, and the area 310 below the edge 305 comprises conductive strip and polyimide film while the area 315 above the edge 305 comprises polyimide film only. In this case, contact 210 features a small conductive pad, electrically decoupled from first section 112 and second section 114, for soldering at contact 220 to PCB 202. Alternative embodiments will also be shown and described in conjunction with FIG. 15.

The views in FIG. 3 further illustrate how the conductive strip 110 can be shaped (relative to an x/y axis) with a width sufficient to wind about the encased electronic components of the PCB 202. The narrower portion 114 of the conductive strip 110 can be rectilinear, curvilinear, or piece-wise rectilinear with angle changes (relative to the x axis) at one or several corners 320 along the length of portion 114, so that antenna portion 114 has variable helical pitch when conductive strip 110 is rolled around core 106.

Figure 4:
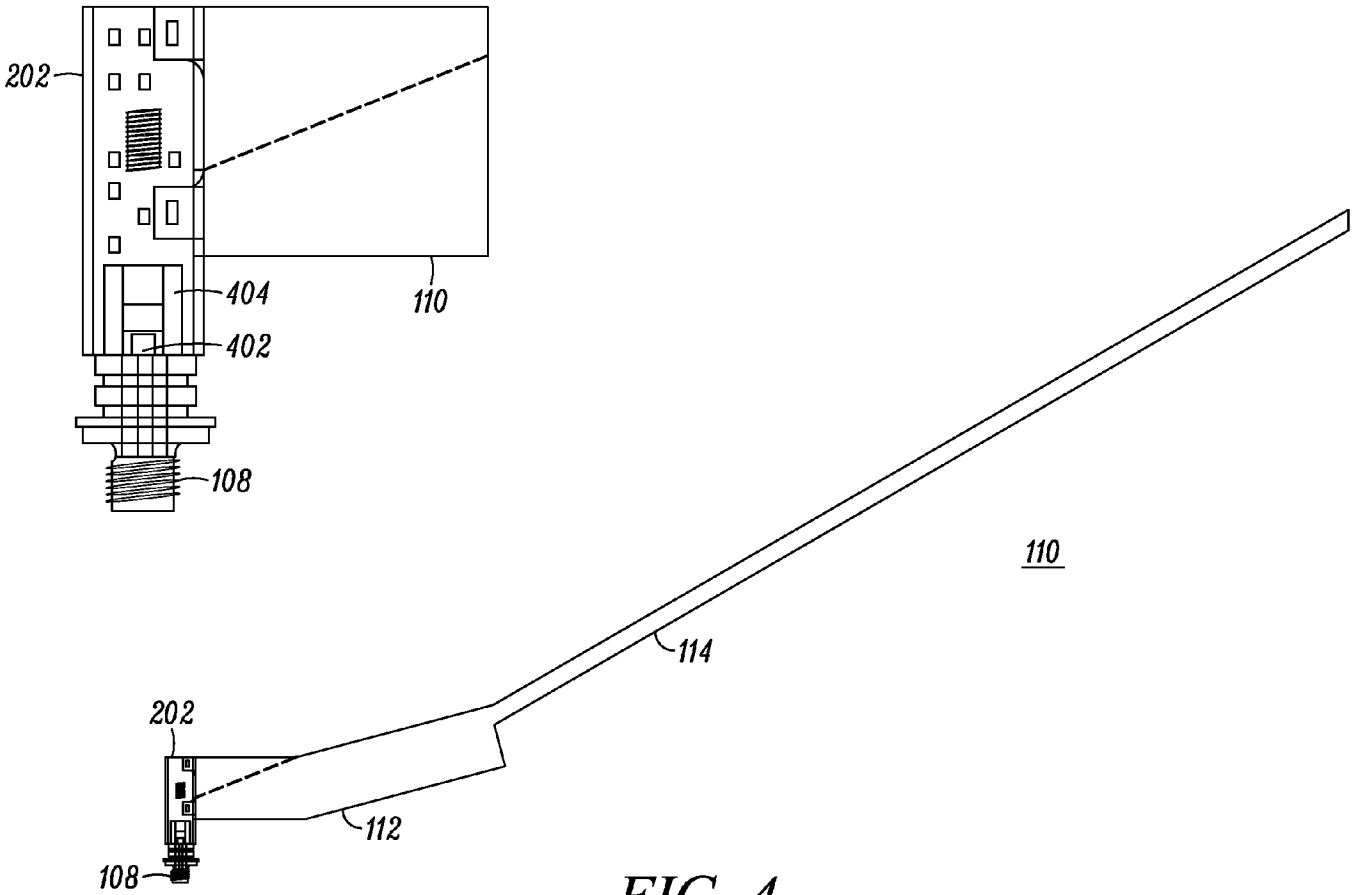
FIG. 4 shows the PCB, the conductive strip flat pattern of FIG. 1 realized on flex circuit board, and a connector in both a close-up view and a full view.

FIG. 4 shows the PCB 202, the connector 108, and the conductive strip 110 in both a close-up view and a full view. Depending on the manner of assembly, the connector may be attached later but for the purposes of illustration, the interface between the connector 108 and PCB 202 is provided here. As mentioned earlier, a variety of attachment means can be used to mount the antenna 100 to an electronic product. In this embodiment a SMA connector is provided as an attachment means. Such a connector may, for example, provide a pronged fork interface within which the PCB 202 can mount for RF contact at 402 and grounding (GND) at 404. This configuration can be mounted within a casing 104, or as shown in the next views the PCB 202 can be inserted into the casing 104 first and then have the connector coupled to the casing 104 and PCB 202.

Figure 5:
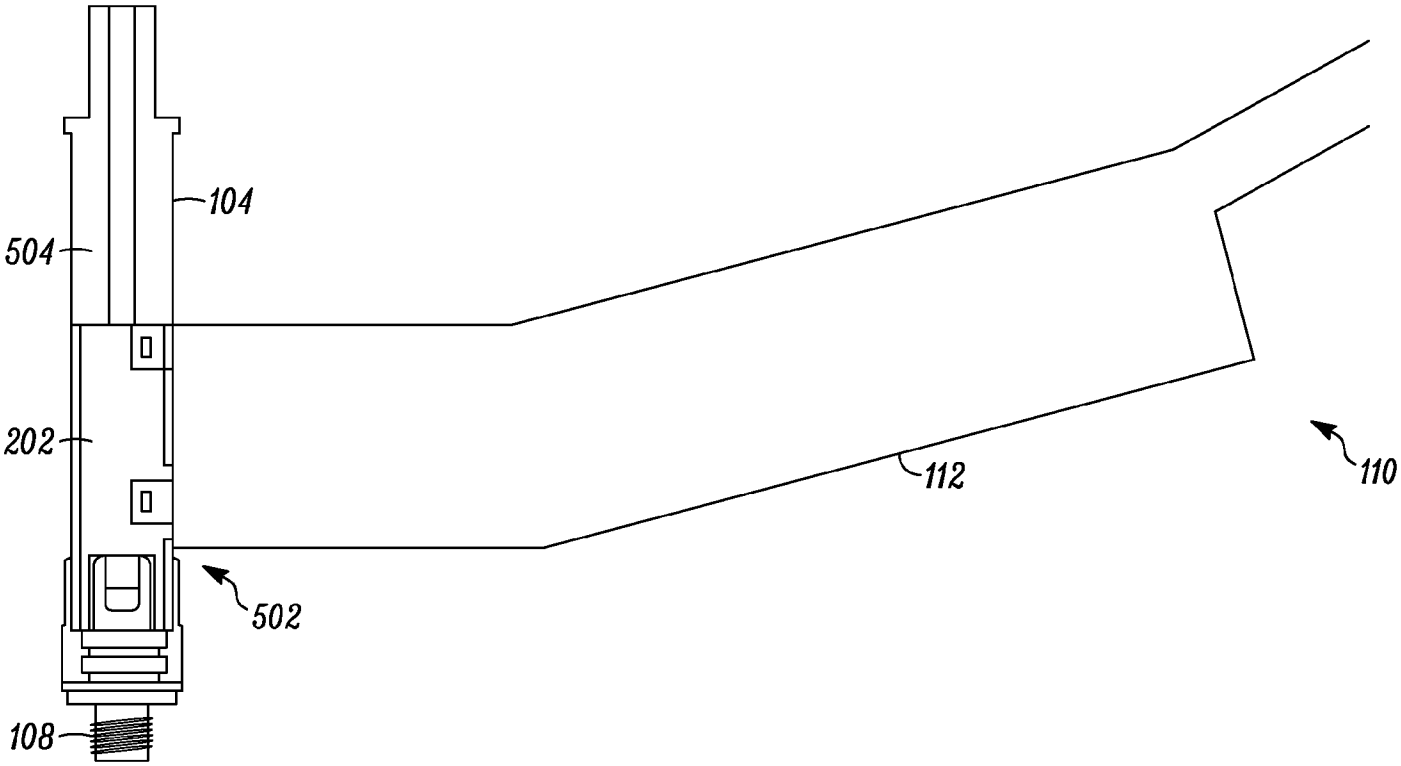
FIG. 5 shows the PCB with conductive strip coupled thereto aligned within a first half of the casing in accordance with the various embodiments.

FIG. 5 shows the PCB 202 with conductive strip 110 coupled thereto aligned within a first half 504 of casing 104. Casing 104 may be a molded housing formed from a thermoplastic material, such as polypropylene, acrylonitrile butadiene styrene (ABS), polycarbonate or other thermoplastic or thermoset material, or formed (cast) in place with epoxy. Regardless of which manufacturing method is used, the casing material needs to have low loss RF properties. Each half of casing 104 forms a portion of a slot 502. Upon insertion of the PCB 202 into the portion of slot 502, the RF 402 and GND 404 contacts of the PCB align with the corresponding contacts of the pronged connector 108. While different casing configurations can be used, the ability to slide the PCB 202 into the portion of slot 502 of the half casing 504 facilitates alignment of the PCB 202 with the connector 108.

Figure 6:
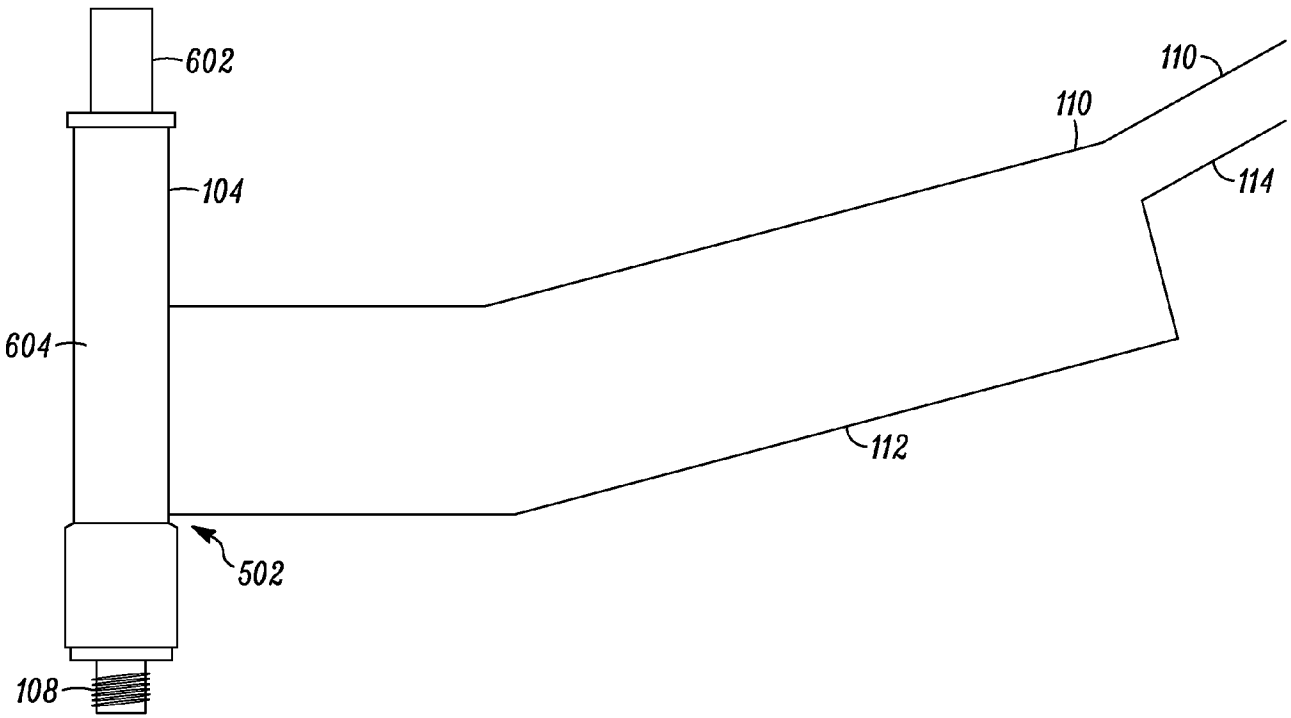
FIG. 6 shows a second half of the casing with the conductive strip extending from the slot in accordance with the various embodiments.

FIG. 6 shows the second half 604 of casing 104 with the conductive strip 110 extending from slot 502. Again, casing 104 may be a pre-molded casing having slot 502 formed therein and within which the PCB 202 is inserted. This mounting configuration advantageously facilitates the wrapping of the wider section 112 about the casing so as to encase the PCB 202 with overlapping successive turns. Casing 104 further comprises an interface 602 for coupling to the rod.

Figure 7:
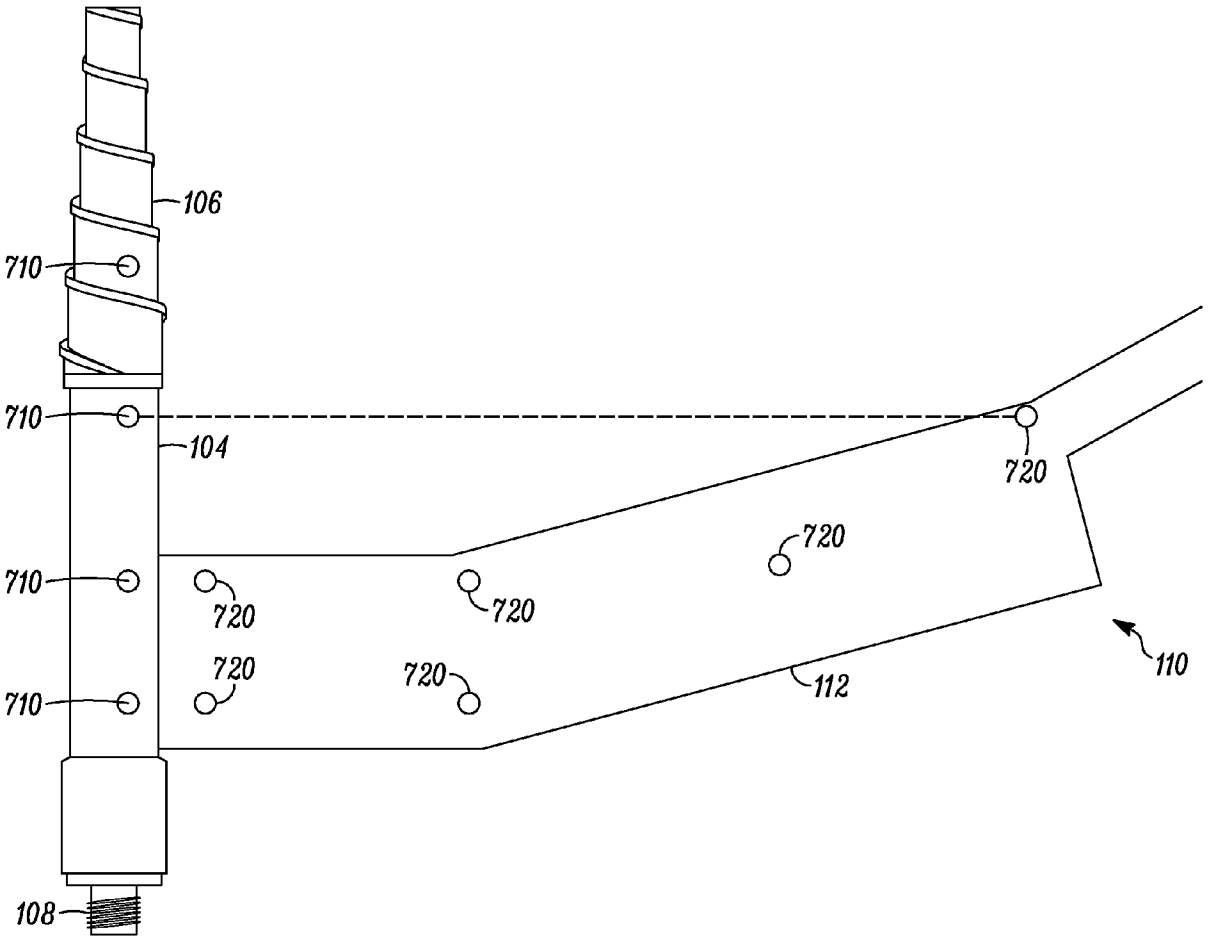
FIG. 7 shows casing with conductive strip mounted therein along with an antenna rod mounted thereto in accordance with the various embodiments. Also shown are pegs in the casing and antenna rod to aid in proper alignment with corresponding holes in the conductive strip.

FIG. 7 shows casing 104 with conductive strip 110 mounted therein along with the rod 106 coupled thereto. This portion of the assembly shows rod 106 mounted to the casing 104 in preparation for wrapping the conductive strip 110. The first half 504 or the second half 604 of casing 104, or both, may feature small extrusions (pegs) 710 used as alignment features for corresponding holes 720 realized on conductive strip 110 to increase the consistency of the antenna construction and reduce mechanical stress to soldered interfaces 210/220 and 215/225 due, for instance, to pull applied to conductive strip 110 during antenna assembly or during use due to friction with the antenna cover, such as a urethane sleeve, which may happen when a user exerts torque on the cover to connect the antenna to a radio.

Figure 8:
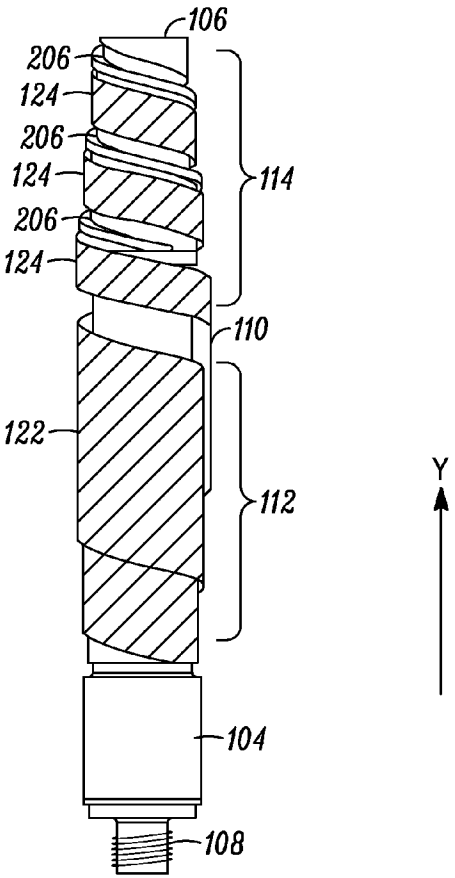
FIG. 8 shows the rod coupled to the casing, and the rolled conductive strip wrapped about the casing with overlapping and non-overlapping successive turns in accordance with the various embodiments.

FIG. 8 shows the flexible rod 106 coupled to the casing 104, and the rolled conductive strip 110 wrapped about the casing with overlapping successive turns 122 along first section 112 resulting in the conductive side (marked with hatching) of the first section 112 facing outside. The insulating layer of the conductive strip prevents shorts between the overlapping successive turns. The amount of overlap and number of successive overlapping turns can be altered to facilitate tuning in the UHF band. The rolled conductive strip 110 transitions to non-overlapping successive turns 124 in second section 114 about the rod 106. In this embodiment, the helical ridge 206 of rod 106 facilitates the winding to the conductive strip 110 about the rod 106. The embodiment shown in FIG. 8 features conductive strip 110 rolled following a counter-clockwise path as seen by a hypothetical observer looking in the positive y axis direction. An alternative embodiment (not shown) features conductive strip 110 rolled following a clockwise path as seen by a hypothetical observer looking in the positive y axis direction. In such a case, the non-conductive side of the first section 112 is facing outside and the helical ridge 206 follows a similar clockwise path as it moves in the positive y direction.

Figure 9:
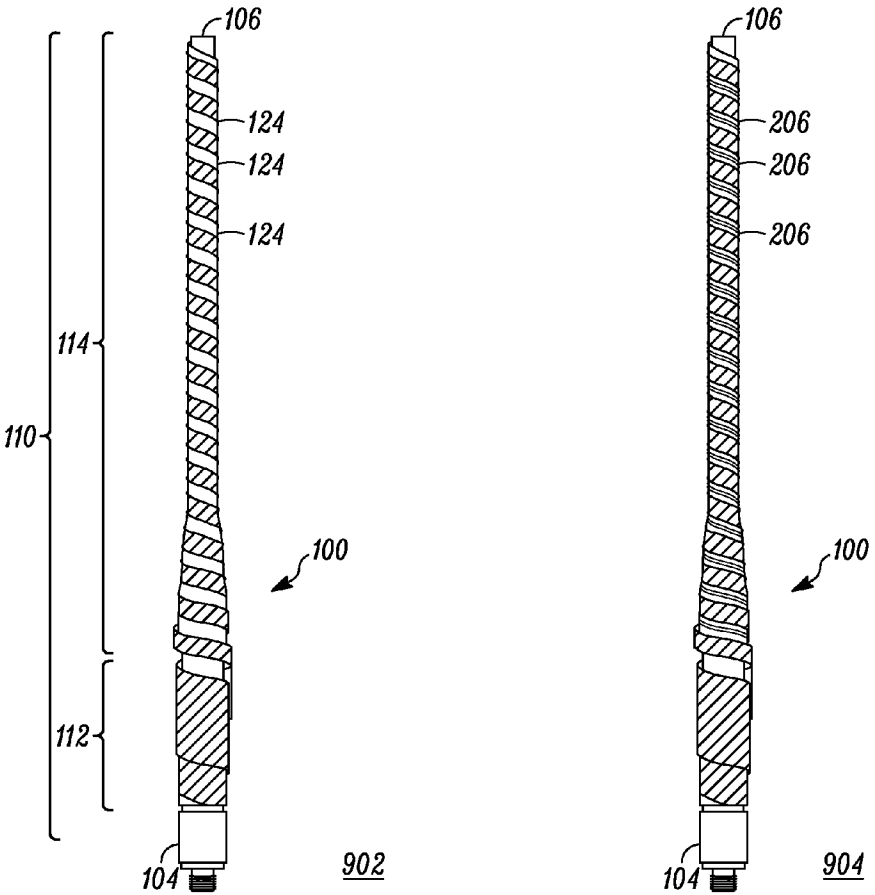
FIG. 9 shows two views of the antenna formed in accordance with the various embodiments.

FIG. 9 shows two views of the antenna 100. View 902 shows the casing 104, which encases the matching circuitry, coupled to the flexible rod 106. The rolled conductive strip 110 is wrapped about the casing 104 with overlapping successive turns, and the rolled conductive strip transitions to no overlap between successive turns about the rod 106. In this embodiment, the flexible rod 106 decreases in diameter along a vertical axis. View 904 shows the flexible rod 106 comprising the helical ridge 206 formed along a vertical axis of the flexible rod which facilitates alignment of the non-overlapping successive turns of the rolled conductive strip 110. Antenna 100 has thus been formed by a single radiator element formed of a single conductive strip wrapped in a first overlapping configuration and a second non-overlapping configuration. The completed antenna is then covered with a flexible protective jacket (not shown), such as a urethane sleeve.

Figure 10:
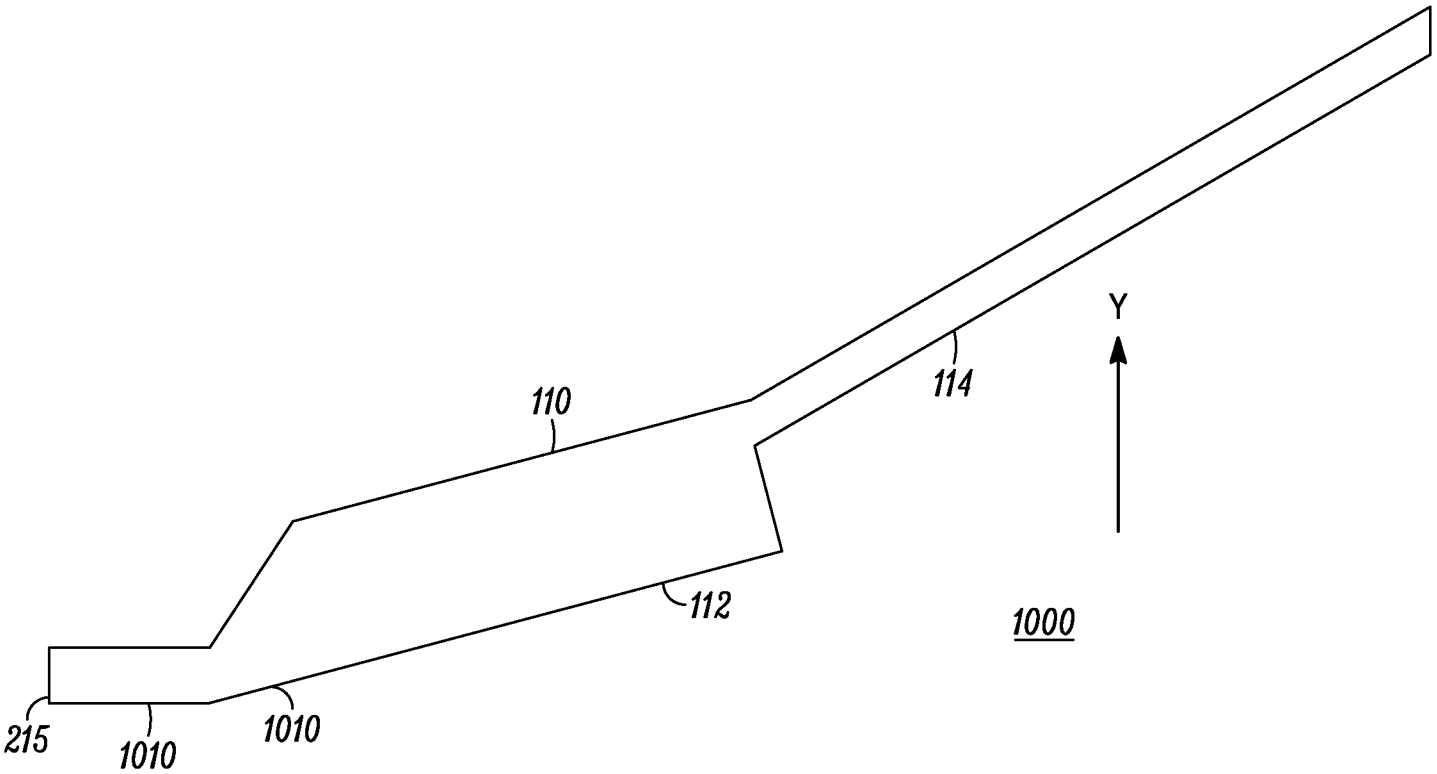
FIG. 10 shows an alternative embodiment of a conductive strip formed in accordance with the various embodiments.

The embodiments described so far feature conductive strip 110 that is first coupled to PCB 202 and then rolled around casing 104 and around core 106. Consequently, the overlapping turns 122 feature each successive turn, starting from the interfaces 210/220 and 215/225, on the outside of each preceding turn. An alternative embodiment can be realized where each successive turn is on the inside of each preceding turn, with the limitation that only one interface, either interface 210/220 or interface 215/225, between conductive strip 110 and PCB 202 is used. FIG. 10 illustrates how, by bending the lower edge 1010 of first section 112 of conductive strip 110 towards the positive y direction in the immediate vicinity of contact 215, the practical realization of such an alternative embodiment 1000 may be enabled.

Some examples of sample data are provided for an antenna formed in accordance with the various embodiments. For the data in the following graphs, a conductive strip formed of copper coated polyimide that measured 6.5 mm wide at the top and 20 mm wide at the bottom was used. The bottom section consisted of 2 overlapping turns using a pitch of 10 mm around a 10 mm diameter ABS casing, and the top section used 18 non-overlapping turns and a pitch of 8.5 mm around a silicone rod whose diameter varied from 10 mm at the bottom to 6 mm at the top; the total length of this antenna was 20 cm. The disclosed antenna was compared to two tri-band antennas known in the art, one with a wire structure, incorporating a PCB with a matching circuit near the base connector, with a length of 24 cm and the other also of a wire structure, also incorporating a PCB with a matching circuit near the base connector, with a length of 21 cm. Data was taken to compare antenna gain over the VHF and UHF bands, while the efficiency metric was used in the 7/800 MHz band.

Figure 11:
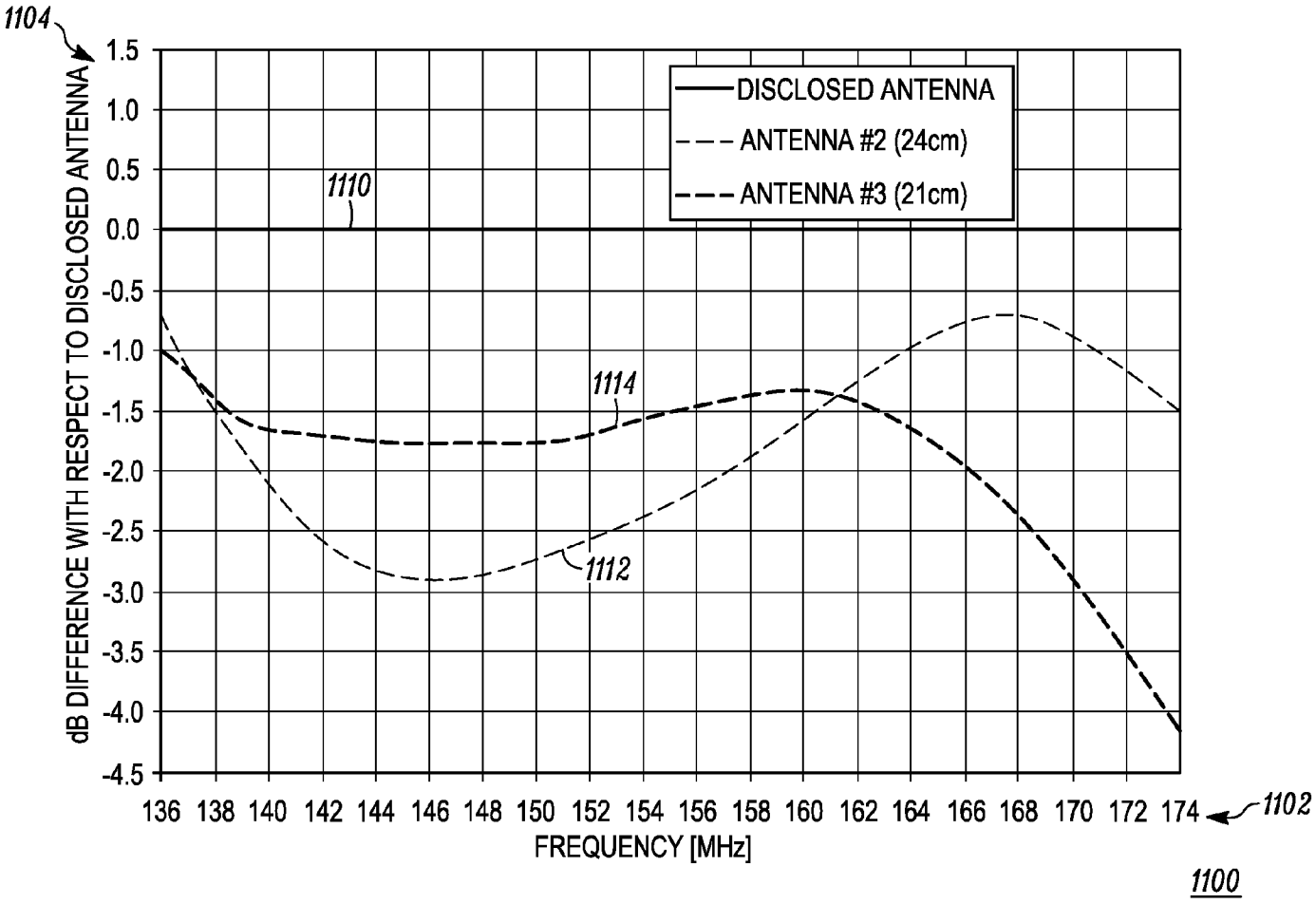
FIG. 11 is a graph providing an example of gain over the VHF band for an antenna formed in accordance with the various embodiments, compared with two alternative antennas available in the marketplace.

FIG. 11 is a graph 1100 showing frequency (VHF band) along a horizontal axis 1102 versus dB difference with respect to the disclosed antenna along a vertical axis 1104 in accordance with the various embodiments. Measurements 1110, 1112, and 1114 indicate that the antenna formed in accordance with the present invention, even though it is 4 cm shorter than one of the tri-band antennas known in the art (Antenna #2) and 1 cm shorter than the other tri-band antennas known in the art (Antenna #3), provides, in some portion of the VHF band, almost 3 dB gain improvement relative Antenna #2 and up to 4 dB gain improvement relative to Antenna #3, while across the whole VHF band it provides at least 0.7 dB better gain than Antenna #2 and at least 1 dB gain improvement on Antenna #3. On average across the VHF band, the antenna formed in accordance with the present invention performs about 1.6 dB better than Antenna #2 and about 1.9 dB better than Antenna #3.

Figure 12:
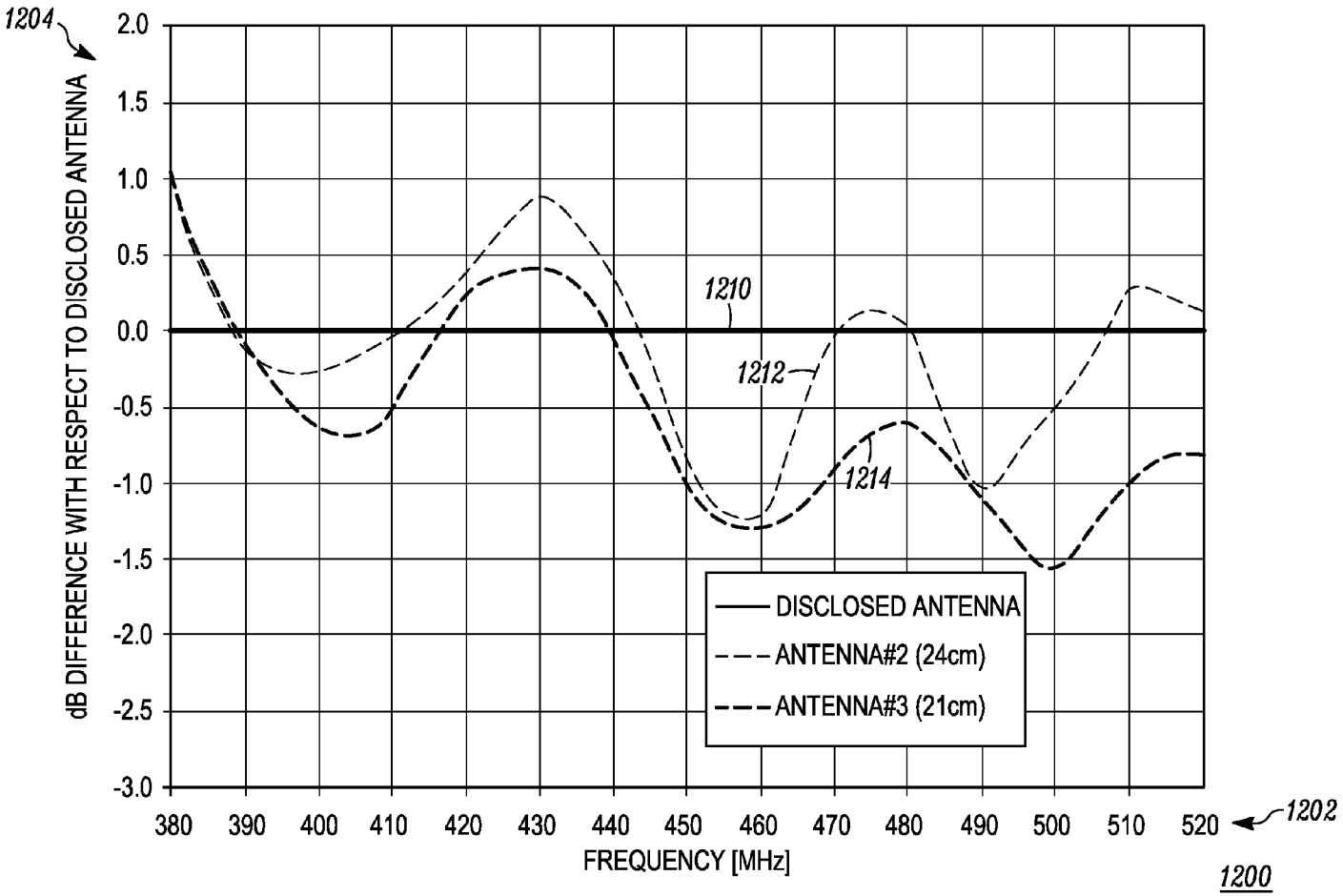
FIG. 12 is a graph providing an example of gain over the UHF band for an antenna formed in accordance with the various embodiments, compared with two alternative antennas available in the marketplace.

FIG. 12 is a graph 1200 showing frequency (UHF band) along a horizontal axis 1202 versus dB difference with respect to the disclosed antenna along a vertical axis 1204 in accordance with the various embodiments. Measurements 1210, 1212, and 1214 indicate that the antenna formed in accordance with the present invention, even though it is substantially shorter than the aforementioned tri-band antennas known in the art, provides, in most of the UHF band, some gain improvement relative Antenna #2 and at least 0.6 dB gain improvement relative to Antenna #3. On average across the UHF band, it performs on par with Antenna #2 and about 0.6 dB better than Antenna #3.

Figure 13:
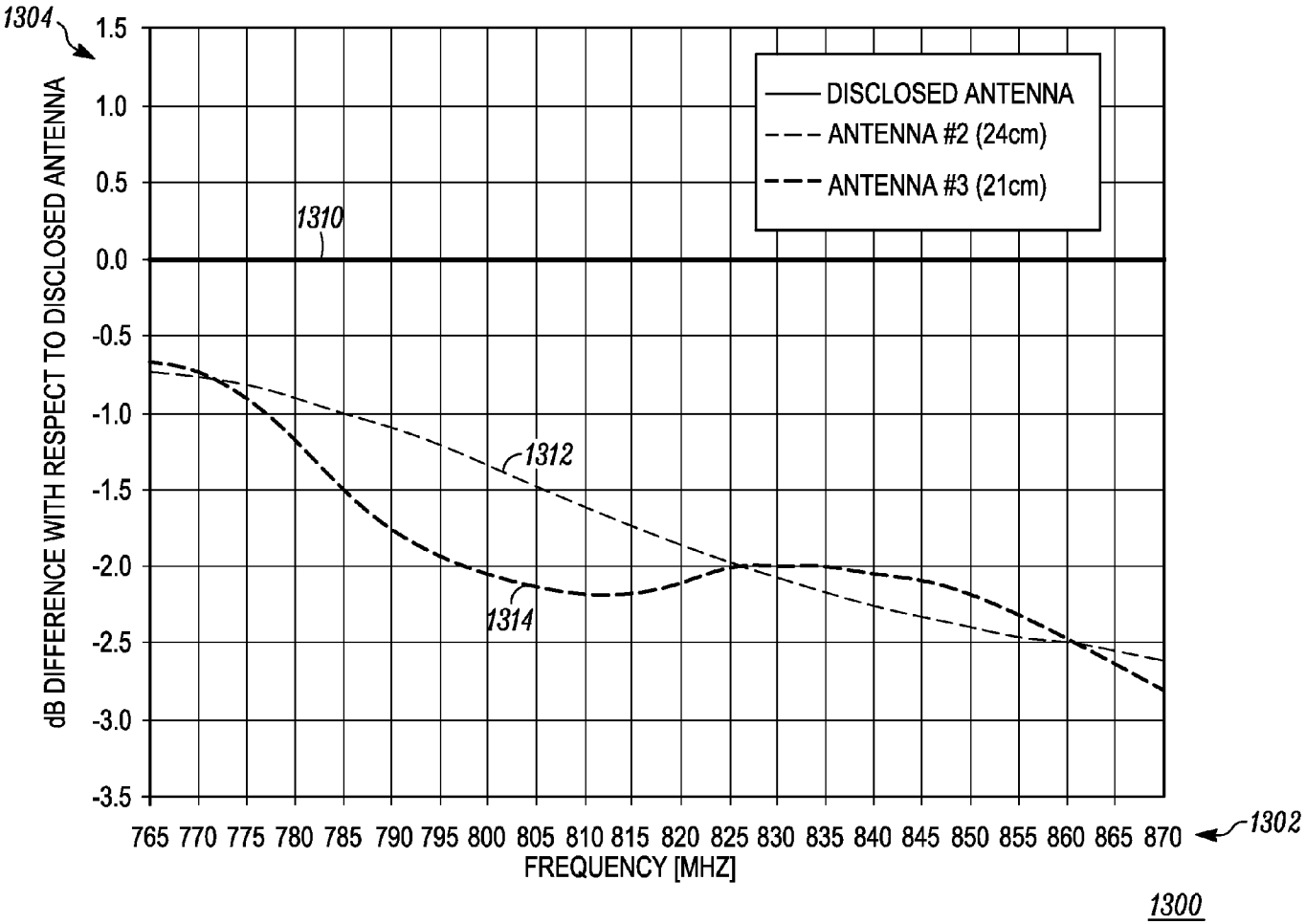
FIG. 13 is a graph providing an example of efficiency over the 7/800 MHz band for an antenna formed in accordance with the various embodiments, compared with two alternative antennas available in the marketplace.

FIG. 13 is a graph 1300 showing frequency in the 7/800 MHz band along a horizontal axis 1302 versus dB difference in antenna efficiency with respect to the disclosed antenna along a vertical axis 1304 in accordance with the various embodiments. Efficiency is measured at each frequency by collecting the total RF power emitted from an antenna and dividing it by the RF power supplied to the antenna. Measurements 1310, 1312, and 1314 indicate that the antenna formed in accordance with the present invention, even though it is substantially shorter than the aforementioned tri-band antennas known in the art, provides at least 0.7 dB improvement in efficiency over the 7/800 MHz band over both Antenna #2 and Antenna #3. On average across the band, it performs about 1.6 dB better than Antenna #2 and about 1.7 dB better than Antenna #3.

The data from FIGS. 11-13 indicate that the antenna formed in accordance with the various embodiments having a single radiating element provides improvements in performance over with an easily manufacturable, low cost structure.

Figure 14:
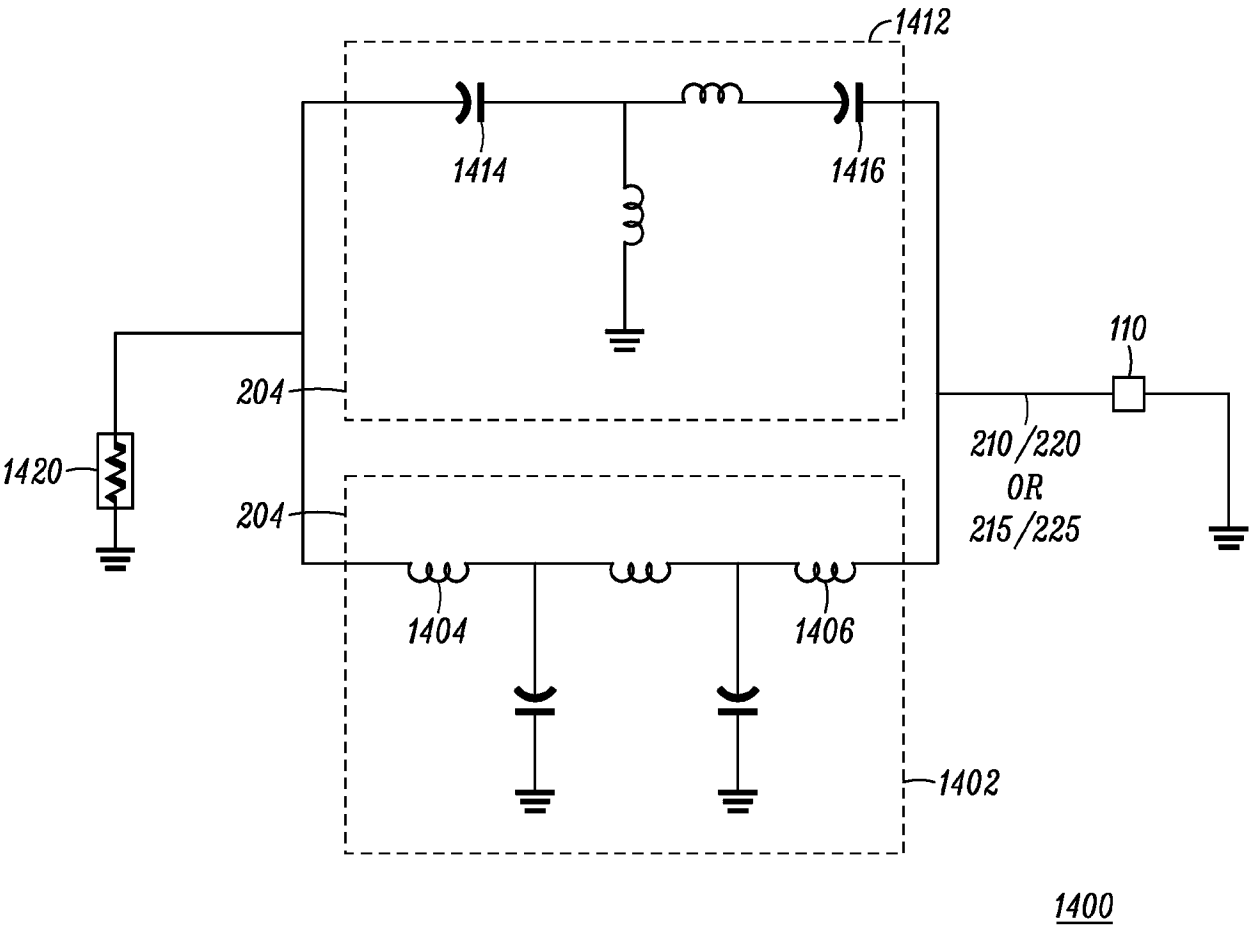
FIG. 14 is an example of an impedance matching circuitry for the antenna formed in accordance with the various embodiments.

FIG. 14 is an example of an impedance matching circuitry 1400, for circuitry 204 of FIG. 2, for the antenna embodiments. Impedance matching circuit 1400 provides a distributed impedance matching function within the antenna structure. In this embodiment, the parts count of the electronic components 204 has been minimized to nine components by encasing the distributed matching circuit 1400 in casing 104 and wrapping the casing with overlapping successive turns 122 of conductive strip 110. This embodiment features two RF signal paths. A first RF signal path 1402 used to perform impedance match separately for the VHF band, and a second RF signal path 1412 used to perform impedance match for the UHF and 7/800 MHz bands. The first signal path 1402 features input series inductor 1404 and output series inductor 1406 which perform a choking function to limit the bi-directional flow of RF signals operating in the UHF and 7/800 MHz bands. The second signal path 1412 features input series capacitor 1414 and output series capacitor 1416 which perform a choking function to limit the bi-directional flow of RF signals operating in the VHF band.

Alternatively, first signal path 1402 could be designed to allow the bi-directional flow of RF signals operating in the VHF and UHF bands but not those in the 7/800 MHz band, and second signal path 1412 could be designed to allow the bi-directional flow of RF signals operating in the 7/800 MHz band but not those in the VHF and UHF bands. More broadly, first signal path 1402 performs a low-pass function while also providing impedance match between transceiver 1420 and conductive strip 110, while second signal path 1412 performs a high-pass function while also providing impedance match between transceiver 1420 and conductive strip 110. The actual topology of RF paths 1402 and 1412 and the selection of electronic components 204 depend on the performance characteristics of conductive strip 110, so they may be varied according for different geometries of conductive strip 110.

The data taken in FIGS. 11-13 utilized only nine electronic components in its matching circuit 1400, as opposed to the two antennas to which it was compared which had about twenty components. The utilization of fewer components in the matching circuit 1400 simplifies PCB layout, allows for the use of larger, thus more RF-efficient, components, or of a smaller PCB, and reduces the part count, thus the cost, of the antenna. Thus, antenna 100 provides improved performance with minimal matching circuitry allowing the PCB 202 to be small, which in turn allows for a compact casing 104. It will be appreciated that the impedance matching circuit 1400 can be modified in accordance with optimization of the antenna 100, however the antenna structure formed in accordance with the various embodiments having an overlapping first section transitioning to a non-overlapping second section has been shown to reduce the overall number of matching components required.

Figure 15:
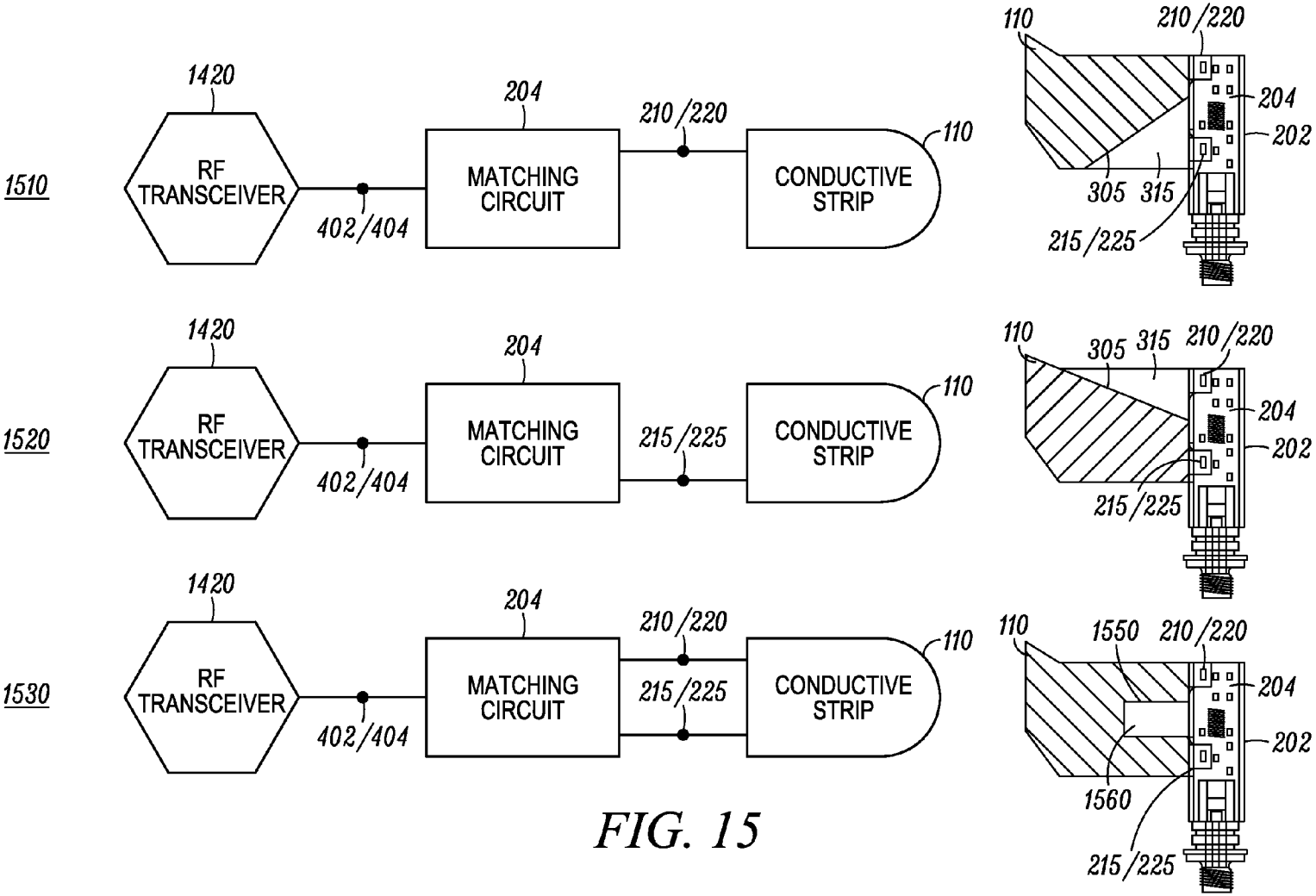
FIG. 15 shows various feeding architectures for the conductive strip of the antenna formed in accordance with the various embodiments.

FIG. 15 shows various architecture embodiments for feeding conductive strip 110. For illustration purposes, in order to show the metal side of the flex with cross hatching (instead of dotted lines from the film side used in FIG. 3), the flex is shown coming off the other side of the PCB 202.

Architecture 1510 shows conductive strip 110 electrically coupled to the matching circuit 204 via contact/pad interface 210/220. Architecture 1510 further shows conductive strip 110 physically coupled to PCB 202 but electronically decoupled from the matching circuit 204 at interface 215/225.

Architecture 1520 shows conductive strip 110 electrically coupled to the matching circuit 204 via contact/pad interface 215/225. Architecture 1520 further shows conductive strip 110 physically coupled to PCB 202 but electronically decoupled from the matching circuit 204 at interface 210/220.

Referring back to FIG. 14, the embodiment 1400 of the antenna matching circuit features a single interface 402/404 with radio frequency (RF) transceiver 1420 and a single interface (either 210/220 or 215/225) with conductive strip 110, therefore it can be employed in architectures 1510 and 1520.

The utility of the swath 315 in architectures 1510 and 1520 is to reduce the impedances for the output chokes (inductor 1406 and capacitor 1416) of RF paths 1402 and 1412. Particularly, if inductor 1406 is reduced in value then a smaller physical component can be utilized or even a more RF-efficient component for the same size of a larger-value inductor. In other words, there can be a mechanical advantage, an electrical advantage, or both.

Architecture 1530 shows conductive strip 110 electrically coupled to the matching circuit 204 via both interfaces 210/220 and 215/225. Architecture 1530 further shows conductive strip 110 physical coupled to the PCB 202 via both interfaces 210/220 and 215/225. In this case, matching circuit 1400 would not be used. Instead, a different circuit topology, featuring three RF ports, would be utilized. In this embodiment, the conductive strip 110 features an edge 1550 which bounds an area or swath 1560 consisting of polyimide film. The swath 1560 of polyimide film introduces electrical length between interfaces 210/220 and 215/225 by modifying the shortest conductive path on conductive strip 110 between said interfaces. Thus, this alternative embodiment comprises a conductive strip comprising a swath 1560 with no metal between first interface 210/220 and second interface 215/225.

Figure 16:
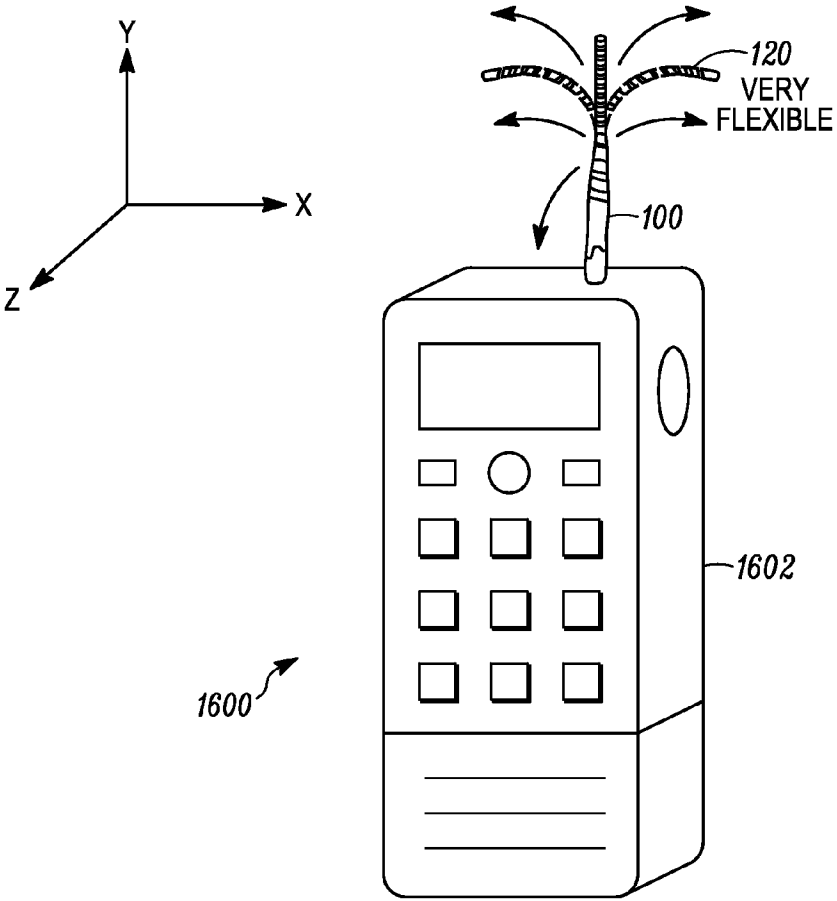
FIG. 16 is a radio having the antenna formed in accordance with the various embodiments.

FIG. 16 is a radio 1600, such as a portable two-way radio, comprising a housing 1602 containing a controller and a transceiver providing tri-band coverage over the VHF, UHF, and 7/800 MHz bands, or sub-bands thereof. The antenna 100, formed in accordance with the various embodiments, provides a multi-band subscriber antenna which is coupled to the radio 1600. Although not shown, antenna 100 would be covered by a flexible jacket, such as a urethane sleeve. The antenna 100 comprises casing 104 which encases impedance matching circuitry. The rolled conducting strip 110 is wound with overlapping successive turns 112 around the casing 104 with an insulating layer between the overlapping successive turns. The flexible rod 106 is coupled to the casing 104. The rolled conductive strip 110 transitions to non-overlapping successive turns 114 along a vertical axis of the flexible rod 106. The section of non-overlapping successive turns 114 along the flexible rod 106 provides 360 degrees of flexibility in the x-z plane about the vertical (y) axis of the rod. Antenna 100, formed in accordance with the various embodiments, provides a single radiator element for multi-band coverage in a very flexible and small form factor.

Various alternatives for the assembly can be implemented. For example, alternative embodiments for the casing 104 may be implemented. While the casing 104 has been described in terms of having first second halves, the casing 104 may be formed as single molded piece part. The single molded piece part may comprise a slot formed therein and a connector coupled thereto. This alternative allows the PCB with flex circuit board attached thereto to be inserted into the slot and aligned within the prongs of the connector without soldering. Alternatively, the PCB can be over-molded with a casing leaving a section exposed for attaching to a connector. As another alternative, the PCB may be coupled directly to electronic circuitry of a product without a connector, as the flexibility of the antenna 100 resides in the upper non-overlapping section 114.

Accordingly, there has been provided a multi-band subscriber antenna of reduced length and stiffness with improved performance that achieves required radiated performance in a plurality of bands simultaneously. A distributed impedance matching function performed by successive turns 112 within the antenna structure leads to substantial performance improvements, for instance by allowing tuning of the UHF band resonance with minimum effect on other bands. This enables simplification of the PCB layout to achieve required impedance match with transceiver 1420 in all three operating bands. The antenna formed in accordance with the various embodiments may be implemented utilizing fewer matching components than alternative antennas available in the marketplace thereby simplifying PCB layout and reducing cost. In addition, the disclosed antenna arrangement results in a more compact and flexible antenna.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An antenna structure, comprising:

a rolled conductive strip having a first section with overlap between successive turns of the conductive strip and a second section with no overlap between successive turns of the conductive strip, the first section having an insulating layer between the overlapping successive turns of the conductive strip.

2. The antenna structure of claim 1, further comprising:

a flexible rod about which the second section is wrapped.

3. The antenna structure of claim 2, wherein the rod comprises a through-hole.

4. The antenna structure of claim 3, wherein the rod accommodates an additional radiating element.

5. The antenna structure of claim 2, wherein the flexible rod comprises a helical ridge formed along a vertical axis of the flexible rod to facilitate alignment of the non-overlapping successive turns of the rolled conductive strip.

6. The antenna structure of claim 1, wherein the rolled conductive strip comprises a single-sided flex circuit board having metal on one side and a non-conductive film on the opposite side.

7. The antenna structure of claim 1, further comprising electronic circuitry coupled to the rolled conductive strip at two interfaces.

8. The antenna structure of claim 1, further comprising electronic circuitry coupled to the rolled conductive strip, wherein the electronic circuitry comprises a low-pass signal path and a high-pass signal path.

9. The antenna structure of claim 1, wherein the overlapping successive turns of the rolled conductive strip in the first section are overlapping in a radial direction extending from a vertical axis of the antenna structure.

10. The antenna structure of claim 9, wherein the insulating layer is formed on a back side of the rolled conductive strip so as to provide electrical insulation between the overlapping successive turns of the rolled conductive strip in the first section.

11. An antenna, comprising:

impedance matching circuitry;

a casing for encasing the impedance matching circuitry;

a flexible rod coupled to the casing;

a rolled conductive strip wrapped about the casing with overlapping successive turns, the rolled conductive strip transitioning to non-overlapping successive turns about the flexible rod; and an insulating layer between the overlapping successive turns.

12. The antenna of claim 11, wherein the insulating layer prevents shorts between the overlapping successive turns of the rolled conductive strip.

13. The antenna of claim 11, wherein the rolled conductive strip is formed of a single-sided flex circuit board having metal on one side and a polyimide film on the opposite side, the polyimide film providing the insulating layer between the overlapping successive turns.

14. The antenna of claim 11, wherein the flexible rod further comprises a helical ridge formed along a vertical axis of the flexible rod to facilitate alignment of the non-overlapping successive turns of the rolled conductive strip.

15. The antenna of claim 11, wherein the impedance matching circuitry is mounted to a printed circuit board (PCB), and the conductive strip is coupled to the PCB, and the casing is formed of first and second halves forming a slot within which the rolled conductive strip is inserted.

16. The antenna of claim 15, wherein the impedance matching circuitry comprises a low-pass signal path and a high-pass signal path coupled with the conductive strip at an interface.

17. The antenna of claim 15, wherein the impedance matching circuitry comprises a low-pass signal path coupled with the conductive strip at a first interface and a high-pass signal path coupled with the conductive strip at a second interface; and the conductive strip comprises a swath with no metal between the first and second interface.

18. The antenna of claim 11, wherein the flexible rod further comprises a through-hole along a vertical axis for accommodating an additional radiator element.

19. The antenna of claim 11, further comprising:

extrusions formed on the casing providing alignment features for corresponding holes formed within the conductive strip.

20. The antenna of claim 11, wherein the overlapping successive turns of the rolled conductive strip are overlapping in a radial direction extending from a vertical axis of the antenna.

21. A radio, comprising:

an antenna coupled to the housing, the antenna comprising:

a casing having an impedance matching circuit encased therein;

a rolled conductive strip coupled to the PCB, the rolled conductive strip being wound with overlapping successive turns around the casing with an insulating layer between the overlapping successive turns; and a flexible rod coupled to the casing, the rolled conductive strip transitioning to a non-overlapping successive turns along a vertical axis of the flexible rod.

22. The radio of claim 21, wherein the conductive strip is formed of a single-sided flex circuit board, with metal on one side and the insulating layer on an opposite side, said flex circuit having a variable width, the flex circuit having a relatively wider width and being wrapped about the casing with overlapping successive turns in a first section of the antenna, and having a relatively narrower width and being wrapped along the flexible rod with non-overlapping successive turns in a second section of the antenna.

23. The radio of claim 21, wherein the casing comprises a slot within which a printed circuit board (PCB) is aligned, the PCB having the impedance matching circuit mounted thereon, the rolled conductive strip being coupled to the PCB and extending from the slot.

24. The radio of claim 21, wherein the antenna provides tri-band coverage over: VHF (136-174 MHz), UHF (380-520 MHz), and 764-869 MHz.

25. The radio of claim 21, wherein the overlapping successive turns of the rolled conductive strip are overlapping in a radial direction extending from a vertical axis of the antenna.

* * * * *

UNITED STATES PATENT AND TRADEMARK OFFICE

CERTIFICATE OF CORRECTION

PATENT NO. : 8,884,838 B2
APPLICATION NO. : 13/471721
DATED : November 11, 2014
INVENTOR(S) : Nereydo T. Contreras et al.

It is certified that error appears in the above-identified patent and that said Letters Patent is hereby corrected as shown below:

IN THE SPECIFICATION:

In Column 3, Line 39, delete "conductive strip 100" and insert -- conductive strip 110 --, therefor.

In Column 10, Lines 29-30, delete "non-overlapping successive turns 114" and insert -- non-overlapping successive turns 124 --, therefor.

In Column 10, Line 31, delete "non-overlapping successive turns 114" and insert -- non-overlapping successive turns 124 --, therefor.

In Column 10, Lines 50-51, delete "non-overlapping section 114." and insert -- non-overlapping section 124. --, therefor.

Signed and Sealed this
Seventeenth Day of May, 2016

Michelle K. Lee

Michelle K. Lee
*Director of the United States Patent and Trademark Office*